US007997335B2

(12) United States Patent
Brown et al.

(10) Patent No.: US 7,997,335 B2
(45) Date of Patent: Aug. 16, 2011

(54) JET PUMP WITH A CENTRIFUGAL PUMP

(75) Inventors: Donn J. Brown, Broken Arrow, OK (US); Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 255 days.

(21) Appl. No.: 12/255,454

(22) Filed: Oct. 21, 2008

(65) Prior Publication Data

US 2010/0096141 A1 Apr. 22, 2010

(51) Int. Cl.
*E21B 33/035* (2006.01)
*F04B 23/04* (2006.01)

(52) U.S. Cl. ..... 166/105; 166/105.6; 166/335; 166/369; 417/76; 417/89

(58) Field of Classification Search ..... 166/369, 166/372, 105.6, 105, 335, 368; 405/249, 405/224, 224.1, 224.2, 228, 154.1; 417/199.2, 417/423.3, 424.2, 249, 224.1, 224.2, 224, 417/228, 76, 87, 89
See application file for complete search history.

(56) References Cited

U.S. PATENT DOCUMENTS

| | | | | |
|---|---|---|---|---|
| 4,294,573 | A | 10/1981 | Erickson et al. | |
| 5,403,151 | A * | 4/1995 | Noyes | 415/182.1 |
| 6,068,444 | A | 5/2000 | Sheth | |
| 6,357,530 | B1 | 3/2002 | Kennedy et al. | |
| 7,481,270 | B2 * | 1/2009 | Shepler | 166/105 |
| 2009/0035067 | A1 * | 2/2009 | Wilson et al. | 405/154.1 |

OTHER PUBLICATIONS

U.S. Appl. No. 11/830,263, filed Jul. 30, 2007.

* cited by examiner

*Primary Examiner* — Jennifer H Gay
*Assistant Examiner* — Brad Harcourt
(74) *Attorney, Agent, or Firm* — Bracewell & Giuliani LLP

(57) ABSTRACT

A seafloor pump assembly is installed within a caisson that has an upper end for receiving a flow of fluid containing gas and liquid. The pump assembly is enclosed within a shroud that has an upper end that seals around the pump assembly and a lower end that is below the motor and is open. An extraction tube has an upper end above the shroud within the upper portion of the caisson and a lower end connected to a jet pump. The extraction tube causes gas that separates from the liquid and collects in the upper portion of the caisson to be drawn into the jet pump and mixed with the liquid as the liquid is being pumped.

18 Claims, 2 Drawing Sheets

JET PUMP WITH A CENTRIFUGAL PUMP

FIELD OF THE INVENTION

This invention relates in general to pumping well fluid from the seabed to the surface, and in particular to a pump assembly located within a caisson and having a jet pump to reduce gas accumulation in the caisson.

BACKGROUND OF THE INVENTION

Offshore wells are being drilled in increasingly deeper waters. The wells may have adequate pressure to flow the well fluid to the seabed, but lack sufficient pressure to flow the fluid thousands of feet upward to a production vessel. Proposals have been made to install pumps at the seabed to boost the pressure of the well fluid sufficiently to flow it to the floating production vessel.

Often, the well fluid will be a mixture of hydrocarbon liquid, gas and water. Gas presents a problem for pumps, particularly electrically driven centrifugal pumps. Gas detracts from the efficiency of the pump, and can cause the pump to lock and shut down if a large slug of gas enters.

One proposal for dealing with well fluid having an appreciable quantity of gas is to mount the pump in a caisson. The caisson is located in a tubular bore formed into the seabed and cased to seal it from the earth formations. The caisson may be several hundred feet deep. The well fluid flows in the upper end of the caisson, and gravity causes the liquid to separate from the gas and flow downward in the caisson. The gas tends to collect in the upper portion of the caisson. The submersible pump is located within the caisson at a point where its intake is below the liquid level. The pump is enclosed by a shroud with an inlet at the lower end to force liquid to flow upward by the motor to cool the motor. As the gas cap continues to build, portions will escape and flow into the pump along with the liquid to be pumped into the surface. A possibility exists that the gas cap will grow and push the liquid level too low, resulting in a large quantity of the gas entering the pump and causing it to gas lock. Liquid level controllers have been proposed to open and close the inlet to the caisson to try to maintain the liquid at a desired level above the intake of the pump. A large gas slug could nevertheless still enter the pump and cause a gas lock.

SUMMARY OF THE INVENTION

In this invention, the pump is located within a shroud inside the caisson. The pump assembly consists of a jet pump combined with at least one centrifugal pump. An extraction tube extends from the jet pump and has an upper end for location within a portion of the caisson that normally will be a gas accumulation area above the liquid level. The extraction tube has a lower end in fluid communication with well fluid in the interior of the caisson. The jet pump has a venturi configuration to cause a reduced pressure. The lower end of the extraction tube joins a point of reduced pressure in the venturi. During operation, the venturi configuration creates a suction to draw in a small continuous quantity of gas through the extraction tube as the pump operates to avoid the gas cap from becoming too large.

DETAILED DESCRIPTION OF THE INVENTION

Figure 1:
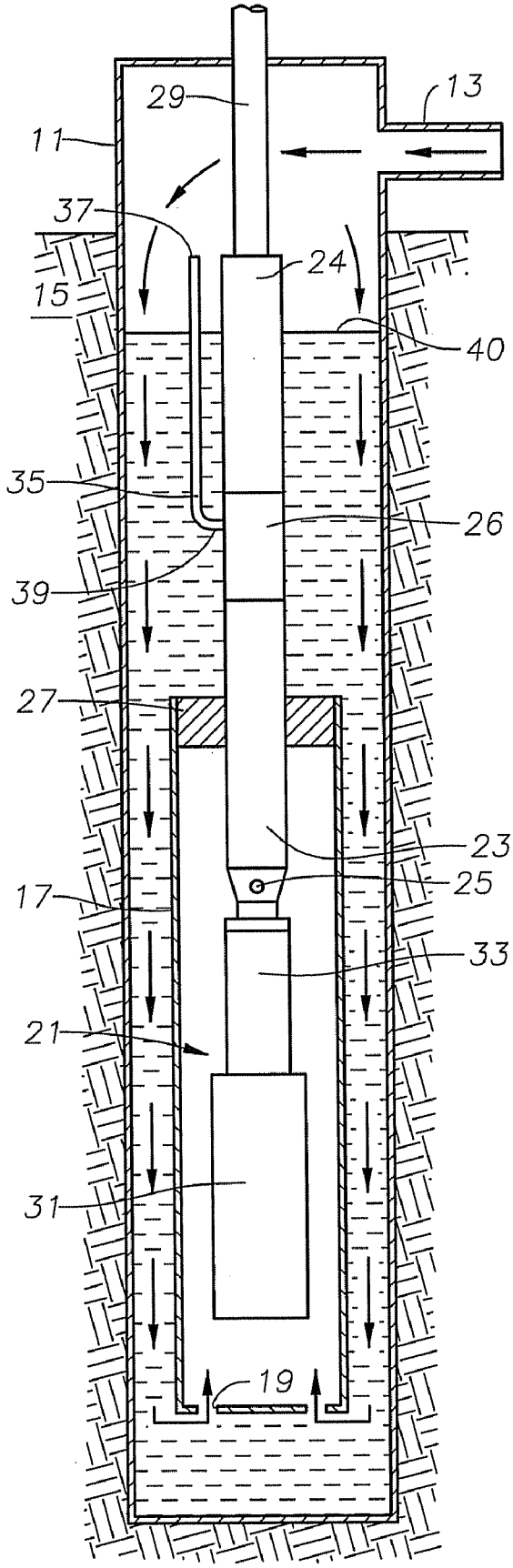
FIG. 1 is a schematic sectional view illustrating a caisson pump apparatus constructed in accordance with a first embodiment of the invention.

Referring to FIG. 1, a caisson 11 is shown schematically. Caisson 11 comprises a hole that has been formed in the seafloor to a desired depth, which may be several hundred feet. Caisson 11 is encased in a casing that is impermeable to any fluids from earth formation 15. Caisson 11 has an inlet 13 that is located near its upper end, such as slightly above the seabed.

A shroud 17 is located within caisson 11. Shroud 17 has an inlet 19 at its lower end. Shroud 17 is a tubular member that is smaller in diameter than the inner diameter of caisson 11 so as to create an annular passage surrounding it for downward fluid flow.

An electrical submersible pump assembly ("ESP") 21 is mounted within shroud 17. ESP 21 has three pumps 23, 24, 26 in this example. Pumps 23, 24 are typically centrifugal pumps. Pump 26 is a jet pump. Each pump 23, 24 is made up of a large number of stages, each having a rotating impeller and a stationary diffuser. Pump 23 has an intake 25 that is located at the lower end of pump 23 within shroud 17. Jet pump 26 is preferably positioned above shroud 17, between pump 23 and pump 24. Shroud 17 has an upper end 27 that seals around a portion of ESP 21 above intake 25. If desired, the entire length of ESP 21 could be enclosed by shroud 17, but the upper end 27 of shroud 17 only needs to be slightly above pump intake 25. A discharge pipe 29 extends upward from pump 24 and out the upper end of caisson 11. Although shown extending through the top of caisson 11, discharge pipe 29 could alternately extend through a sidewall portion of caisson 11. ESP 21 also has an electrical motor 31 that has a shaft 47 (FIG. 2) that drives pumps 23, 24. Motor 31 and pump 23 are conventionally separated by a seal section 33. Seal section 33 equalizes the pressure of lubricant contained in motor 31 with the well fluid on the exterior of motor 31.

An extraction tube 35 has an upper end 37 that is exterior of shroud 17. Extraction tube 35 has an inner diameter much smaller than the inner diameter of discharge pipe 29. Extraction tube 35 has a lower end 39 that is above shroud 17 and in fluid communication with well fluid in the interior of caisson 11.

Figure 2:
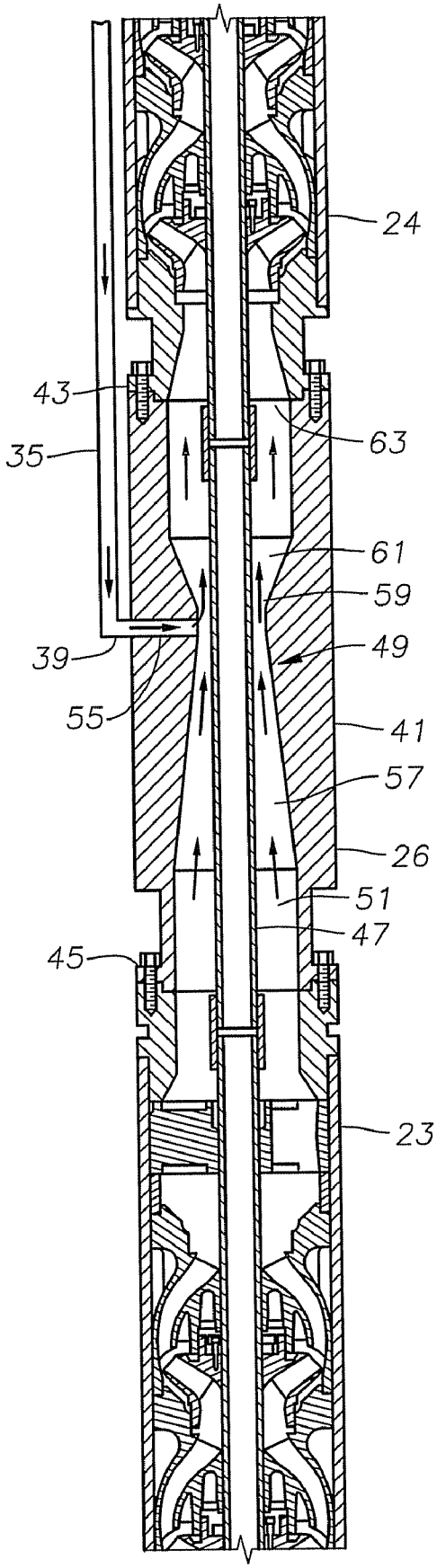
FIG. 2 is an enlarged cross-sectional view of a portion of the caisson pump apparatus of FIG. 1.

Referring to FIG. 2, jet pump 26 is positioned between centrifugal pumps 23, 24, although it could be located above centrifugal pump 24. Jet pump 26 and housing 41 are mounted to pump 24 at upper mounting area 43. Jet pump 26 and housing 41 are mounted to pump 23 at lower mounting area 45. Shaft 47 extends from motor 31 and continues upward through pump 23, jet pump 26, and pump 24. A venturi tube configuration 49 is located within jet pump 26 and extends around shaft 47. Fluid inlet 51 receives fluid from centrifugal pump 23. Venturi tube configuration 49 consists of a convergent entrance 57, a throat region 59, and a divergent outlet 61. Extraction tube 35 enters jet pump 26 through external housing 41 and connects to throat region 59 of venturi configuration 49 at inlet 55. Fluid flows from jet pump 26 and into centrifugal pump 24 through fluid outlet 63.

Extraction tube upper end 37 is positioned above the liquid level 40 in caisson 11 at all times. Optionally, a liquid level controller (not shown) may be employed for controlling the flow of fluid into caisson 11, if desired, to maintain liquid level 40 fairly constant.

In the operation, ESP 21 is placed in shroud 17 and installed in caisson 11. The valve (not shown) to inlet 13 is opened, causing well fluid to flow through caisson inlet 13.

The well fluid is typically a mixture of hydrocarbon liquid, water and gas. Shroud 17 is immersed in liquid in caisson 11, with liquid level 40 being at least above pump intake 25 and preferably above shroud upper end 27. Liquid level 40 will be below caisson inlet 13. A gravity separation occurs as the fluid flows in inlet 13 and downward in caisson 11. This results in gas freeing from the liquid and collecting in the upper portion of caisson 11. The liquid flows down through the annular passage around shroud 17 and into shroud inlet 19. The liquid flows up alongside motor 31 and into pump intake 25. Pumps 23, 24 increase the pressure of the liquid and discharge it through discharge pipe 29 for flowing the liquid to the surface.

As the liquid flows through jet pump 26, the velocity of the fluid increases as it reaches throat region 59. As the fluid velocity increases, venturi 49 causes a reduced pressure in throat region 59. As a result of the pressure drop, a small amount of gas from the gas cap collecting above liquid level 40 will flow through extraction tube 35. The gas leaves extraction tube 35 and mixes with the liquid flowing into jet pump 26 at inlet 55, located within throat region 59. As the fluid and gas mixture passes throat region 59 and continues through divergent outlet 61 the velocity decreases and the pressure increases before passing through outlet 63 and into pump 24. The flow rate of the gas is fairly constant and relatively small compared to the liquid flow rate, thus is readily pumped by pump 24 along with the liquid up discharge pipe 29. The flow area of extraction tube 35 is much smaller than the total flow area of shroud inlet 19 so as to avoid excessive amounts of gas flowing into pump 24.

The invention has significant advantages. By continuously drawing off a small amount of the gas cap, the size of the gas cap is maintained within the caisson at a minimum dimension. Limiting the size of the gas cap prevents the liquid level from dropping so low such that large slugs of gas could enter the shroud and cause gas locking of the pump. By introducing the gas into the fluid stream through the jet pump after a desired number of pump stages, the gas is able to mix with the fluid in a form that the centrifugal pump can handle.

While the invention has been shown in only one of its forms, it should be apparent to those skilled in the art that it is not so limited but is susceptible to various changes without departing from the scope of the invention. For example, the caisson could comprise a housing located on the sea floor, rather than within a hole in the sea floor. The housing could be oriented horizontally or tilted rather than vertically.

The invention claimed is:

1. An apparatus for pumping a flow of fluid containing gas and liquid, the apparatus comprising:

an electrical submersible pump assembly, the pump assembly having an intake, a shaft rotatably driven by an electrical motor, and a discharge pipe for discharging fluid;

a jet pump connected in series with the pump assembly, the jet pump having a venturi with an upstream converging portion, a central portion of reduced diameter, and a downstream diverging portion;

the shaft extending through the venturi of the jet pump; and at least one extraction tube having an upper end located within a gas pocket and a lower end connected to the jet pump for drawing gas from the gas pocket into the jet pump.

2. The apparatus according to claim 1, wherein the lower end of the tube extends to the central portion of the venturi.

3. The apparatus according to claim 1 wherein the pump assembly comprises an upper centrifugal pump and a lower centrifugal pump and the jet pump is positioned between the upper and lower centrifugal pumps.

4. The apparatus according to claim 1, wherein the tube has an inner diameter substantially smaller than an inner diameter of the discharge pipe.

5. The apparatus according to claim 1, wherein the jet pump and the extraction tube are installed in a housing at the sea floor.

6. The apparatus according to claim 1, wherein the sea floor pump apparatus is installed in a caisson having an inlet at an upper end for receiving a flow of fluid containing gas and liquid, and the apparatus further comprises:

a shroud surrounding at least a portion of the pump assembly within the caisson, the shroud having an inlet at a lower end for receiving fluid flowing into the caisson.

7. A sea floor fluid pump apparatus, comprising:

a caisson installed in a sea floor and having an inlet at an upper end for receiving a flow of fluid containing gas and liquid;

an electrical submersible pump assembly within the caisson, the pump assembly having an intake, a shaft rotatably driven by an electrical motor, and a discharge pipe extending sealingly through an upper portion of the caisson;

a jet pump coupled in series with the pump assembly, the jet pump having a venturi with an upstream converging portion, a central portion of reduced diameter, and a downstream diverging portion;

the shaft extending through the venturi of the jet pump, thereby forming an annulus for fluid passage between the outer peripheries of the shaft and the inner surfaces of the venturi;

a shroud surrounding at least a portion of the pump assembly within the caisson, the shroud having an upper end sealed around the pump assembly and an inlet at a lower end for receiving fluid flowing into the caisson, the downward flow of the fluid around the shroud causing at least some of the gas contained therein to separate and collect in an upper portion of the caisson; and at least one tube having an upper end above the shroud within the upper portion of the caisson and a lower end in connected to the jet pump for drawing gas that collects in the caisson into the jet pump.

8. The apparatus according to claim 7, wherein the lower end of the tube extends to the central portion of the venturi.

9. The apparatus according to claim 7, wherein the pump assembly comprises an upper centrifugal pump and a lower centrifugal pump and the jet pump is positioned between the upper and lower centrifugal pumps.

10. The apparatus according to claim 7, wherein the upper end of the tube is located above the shroud.

11. The apparatus according to claim 7, wherein the tube has an inner diameter substantially smaller than an inner diameter of the discharge pipe.

12. The apparatus according to claim 7, wherein the jet pump is located above the shroud.

13. A method of pumping a well fluid from a sea floor, comprising:

(a) connecting a jet pump having a venturi in series with an electrical submersible pump assembly having a shaft rotatably driven by an electrical motor, the shaft extending through the venturi, and installing the jet pump and the electrical pump assembly in a housing;

(b) connecting at least one tube to the jet pump venturi such that an upper end of the tube is within an upper portion of the housing;

(c) flowing a fluid containing a gas and liquid into the housing and operating the pump assembly, causing the fluid to flow into an intake of the pump assembly, which discharges the fluid through a discharge pipe out of the housing; and (d) extracting gas that collects in the upper portion of the housing through the tube and into the jet pump venturi, which discharges the gas into the discharge pipe.

14. The method according to claim 13, further comprising:

maintaining a level of the liquid in the housing below the upper end of the tube.

15. The method according to claim 13, wherein step (a) further comprises:

positioning the upper end of the tube above a shroud surrounding at least a portion of the pump assembly within the housing, the shroud having an inlet at a lower end for receiving fluid flowing into the housing.

16. The method according to claim 13 wherein step (a) further comprises:

connecting the jet pump between an upper centrifugal pump and a lower centrifugal pump.

17. The method according to claim 13, wherein the housing comprises a caisson, and wherein step (c) further comprises:

flowing the fluid downward into the caisson, such that a gravity separation occurs that results in gas freeing from the liquid and collecting in the upper portion of caisson.

18. The method according to claim 13, wherein the housing comprises a caisson, and wherein step (a) further comprises:

positioning the upper end of the tube above a shroud surrounding at least a portion of the pump assembly within the caisson, the shroud having an inlet at a lower end for receiving fluid flowing into the caisson; and wherein step (c) further comprises flowing the fluid downward into the caisson, such that a gravity separation occurs that results in gas freeing from the liquid and collecting in the upper portion of caisson.

* * * * *

UNITED STATES PATENT AND TRADEMARK OFFICE

CERTIFICATE OF CORRECTION

PATENT NO. : 7,997,335 B2
APPLICATION NO. : 12/255454
DATED : August 16, 2011
INVENTOR(S) : Donn J. Brown et al.

It is certified that error appears in the above-identified patent and that said Letters Patent is hereby corrected as shown below:

Column 4, line 42, delete “in” before “connected”

Signed and Sealed this
Twenty-ninth Day of November, 2011

David J. Kappos

David J. Kappos
*Director of the United States Patent and Trademark Office*